US005475879A

United States Patent [19]

Miller

[11] Patent Number: 5,475,879

[45] Date of Patent: Dec. 19, 1995

[54] SWIMMING POOL OVERFLOW PROTECTOR

[76] Inventor: Bernard R. Miller, 412 E. Andrews Ave., Ozark, Ala. 36360

[21] Appl. No.: 272,817

[22] Filed: Jul. 11, 1994

[51] Int. Cl.[6] ..... E04H 4/14

[52] U.S. Cl. ..... 4/508; 4/496; 137/143

[58] Field of Search ..... 4/496, 507, 508; 137/132, 133, 143; 405/108

[56] References Cited

U.S. PATENT DOCUMENTS

| | | | |
|---|---|---|---|
| 495,480 | 4/1893 | Giles | 137/143 X |
| 1,221,251 | 4/1917 | Weinhold | 137/143 X |
| 1,753,427 | 4/1930 | Phillips | 4/507 |
| 2,245,887 | 6/1941 | Wikander | 4/295 |
| 3,908,206 | 9/1975 | Grewing | 4/508 |
| 4,342,125 | 8/1982 | Hodge | 4/508 |
| 4,479,274 | 10/1984 | Biby | 4/496 |
| 4,621,657 | 11/1986 | St. Ledger | 137/426 |
| 4,685,158 | 8/1987 | Lively | 4/508 |
| 4,735,230 | 4/1988 | Detloff | 137/315 |
| 4,819,681 | 4/1989 | Hodak | 4/498 X |
| 5,253,374 | 10/1993 | Langill | 4/508 |

FOREIGN PATENT DOCUMENTS

| | | | |
|---|---|---|---|
| 0004327 | 10/1926 | Australia | 137/143 |
| 0374027 | 6/1907 | France | 137/143 |

*Primary Examiner*—Robert M. Fetsuga

*Attorney, Agent, or Firm*—Henry S. Miller; Rhodes & Ascolillo

[57] ABSTRACT

A system for overflow protection for swimming pools and tanks that conserves water by taking excess water from the bottom of the tank including a weighted hose directed near the bottom of the tank and connected to the protector. The protector has inlet, outlet and vent passages, where the inlet is at an elevation below the surface of the pool and the nadir of the outlet passage is at the surface elevation of the pool and the vent is open. A hose connected to the outlet directs overflow away from the pool. Charging the weighted hose will cause fluid above the outlet elevation to discharge excess fluid. In an alternative embodiment a plug is inserted into the vent and charging the weighted hose will cause the pool to drain to the level of the end of the hose.

4 Claims, 3 Drawing Sheets

SWIMMING POOL OVERFLOW PROTECTOR

BACKGROUND OF THE INVENTION

1. Field of the Invention

This invention relates generally to hydraulics and plumbing apparatus and in particular to such equipment designed for use with storage pool level control and drainage.

2. Description of the Prior Art

There is some interest in controlling the fluid level of pools and ponds and in particular swimming pools that are open. In the event of heavy rain a pool or exterior fish tank for example, could overflow and be damaged or cause damage to the surrounding area. Problems could be minimized if the caretakers of the pool were available to drain the pool or tank, however in the event of a major storm electrical power could be out and without pumps the caretakers would be helpless to act efficiently.

A number of U.S. Patents have been granted that are directed toward controlling the water level in swimming pools and the like. For example, U.S. Pat. No. 4,342,125 issued Aug. 3, 1982 to Hodge discloses an apparatus for maintaining the water level in a pool. U.S. Pat. No. 4,621,657 issued Nov. 11, 1986 to St. Ledger for an automatic water level monitoring system includes a manually adjustable overflow tube and a supply line operated by a diaphragm valve. The U.S. Patent granted to Lively for a swimming pool control system, U.S. Pat. No. 4,685,158 issued Aug. 11, 1987, is electrically controlled and would fail in the event of a power outage. The invention of Detloff, as disclosed in U.S. Pat. No. 4,735,230 and issued Apr. 5, 1988 for an overflow valve system for swimming pools amounts to a water-closet ballcock that will limit the inflow of water to a pool or tank. U.S. Pat. No. 5,253,374 issued Oct. 19, 1993 to Langill discloses a complicated system of plumbing to maintain water level in a pool with out the need for electrical assistance.

There is a need then for a simple, reliable and inexpensive means for overflow protection for open pools exposed to the elements of the weather.

SUMMARY OF THE INVENTION

The invention is directed to a simple system that automatically controls the maximum fluid level in an open pool and also allows for the selective draining of the pool with the addition of a vent plug to the system.

The invention is characterized by a system of hose and a overflow protector that tends not to react to temporary changes in water level such as those caused by normal and typical play activities carried on in swimming pools. Level control systems that simply amount to an open pipe at a selected water level tend to loose a large quantity when activity is high in the pool with the splashing and diving etc. When the activity ceases, the water level can be two or three inches below normal and much of this is from water splashing out of the overflow. Over the course of a season the cost of replacement water can be significant. Taking water from the bottom of the pool and passing it through the system dampens the wave motion and significantly decreases the water that is wasted during high activity periods.

The invention utilizes a conventional swimming pool vacuum hose weighted at one end dropped into the pool. The hose is brought out of the pool, necessarily at a level above the desired water level and connected to the overflow protector. The outlet of the overflow protector is located at an elevation equal to the desired level of the water in the pool. The inlet to the overflow protector is positioned to be below the desired level of water in the pool. An additional feature of the invention is that the overflow protector may be located remotely from the pool as long as the elevation criteria is met. This is particularly advantageous with in ground swimming pools and fish tanks. The overflow protector is adapted to accept a second hose, either garden type or pool vacuum hose on the outlet end that allows the overflow to run off to a selected location.

The overflow protector includes a vent that is necessary for the overflow protection function, however if when the vent is closed and the lines properly charged the system becomes a siphon and will drain the pool.

The invention is then a system that will both protect a pool or tank from overflow and drain it as desired.

It is therefore an object of the invention to provide a new and improved overflow protector for pools and tanks.

It is another object of the invention to provide a new and improved overflow protector for pools and tanks that is reliable and simple to use.

It is a further object of the invention to provide a new and improved overflow protector for pools and tanks that uses no moving or mechanical parts.

It is still another object of the invention to provide a new and improved overflow protector for pools and tanks which are of a durable and reliable construction.

It is still a further object of the invention to provide a new and improved overflow protector for pools and tanks which are low in cost.

It is another object of the invention to provide a new and improved overflow protector for pools and tanks which may be easily and efficiently manufactured and marketed.

These and other advantages, features and objects of the invention will become more apparent from the following description taken in connection with the illustrative embodiment in the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENTS

Figure 1:
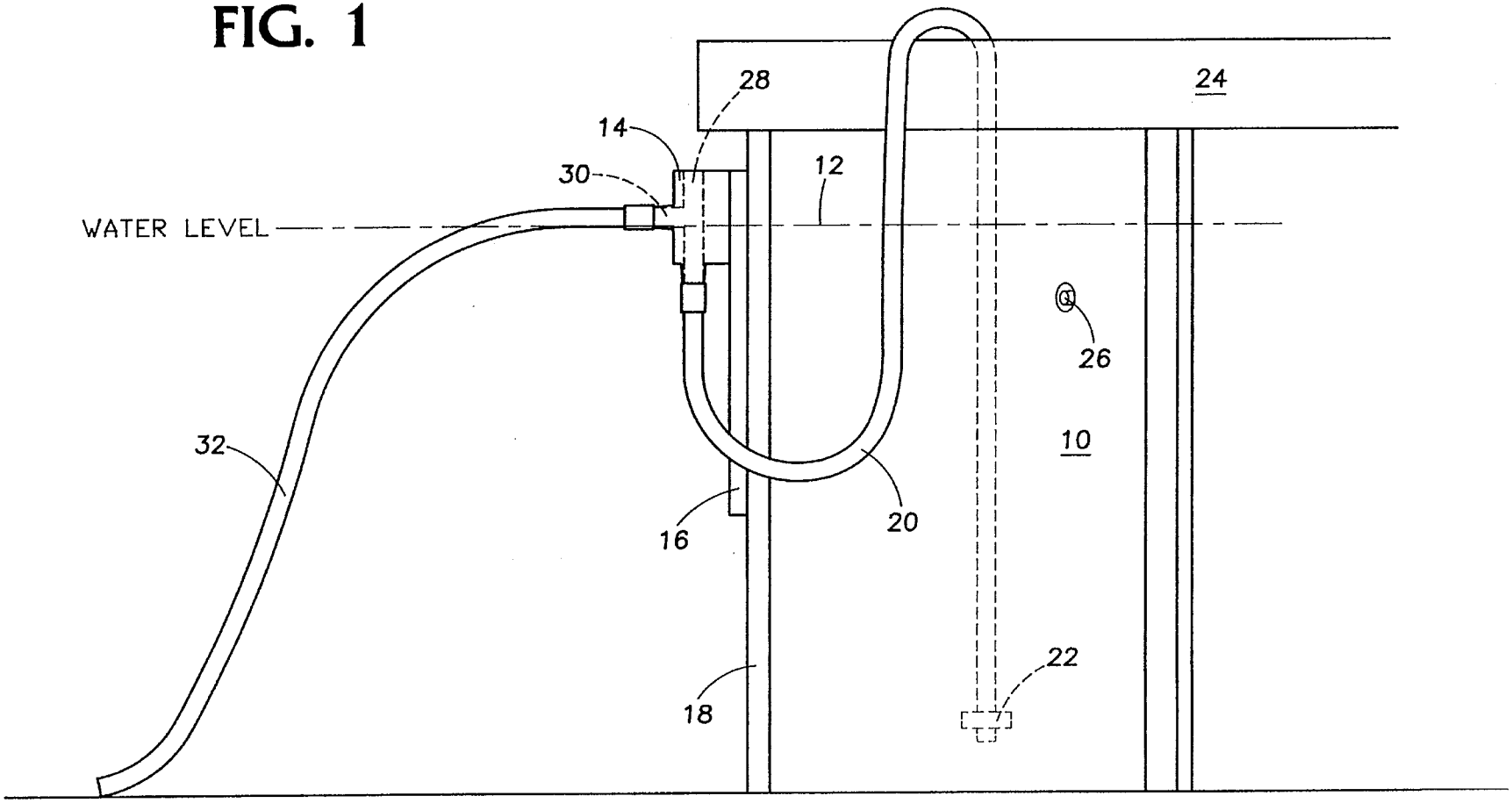
FIG. 1 is a perspective view of the inventive system mounted on an above ground swimming pool.

Referring now to FIG. 1, a pool or tank is shown at 10 containing a level of water identified by line 12. Overflow protector member or protector 14 is mounted on a board or plate 16 which is attached to the tank support beam 18. A swimming pool vacuum hose 20 having a weighted end or weight means 22 is dropped over the edge 24 of the tank and lowered to within approximately two to three inches of the bottom. The weight means is compatible with swimming pool liners and may be vinyl encased soft lead shot. The pool or tank contains a conventional water circulating system having an outlet in the wall shown at 26. Hose 20 is connected to the inlet connector which communicates with the inlet passage of the protector member (the inlet connector is connected to the protector member) 14 which is maintained below the level of the water 12. The protector contains a vertical or inlet passage 28 which is vented to the atmosphere, and a horizontal or outlet passage 30 normal to the inlet passage with its nadir at an elevation that is at the desired water level for the pool.

In use, the inlet hose is charged and filled with water in any convenient manner including placing the end over the outlet 26. With the hose charged and the level of the water filled to the bottom of the outlet passage 30 any additional water will raise the level in the pool or tank causing a rise in the level of the water in the outlet and the discharge of the access through the outlet hose or outlet swimming pool vacuum hose 32.

Figure 2:
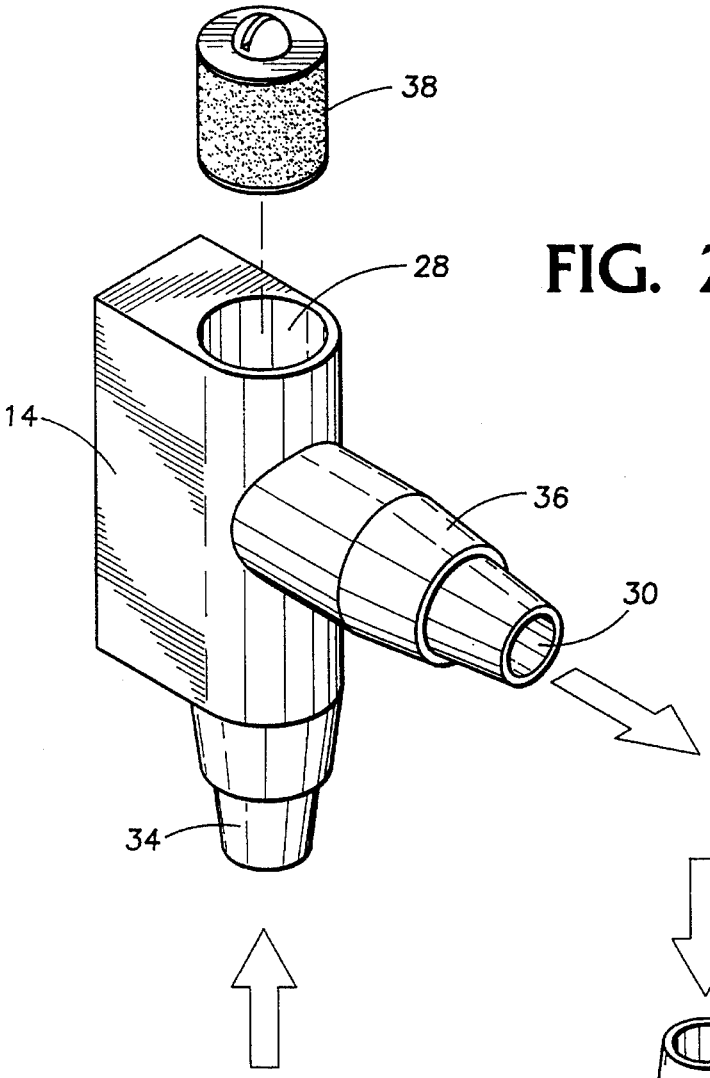
FIG. 2 is a perspective view of the overflow protector if the invention.
Figure 3:
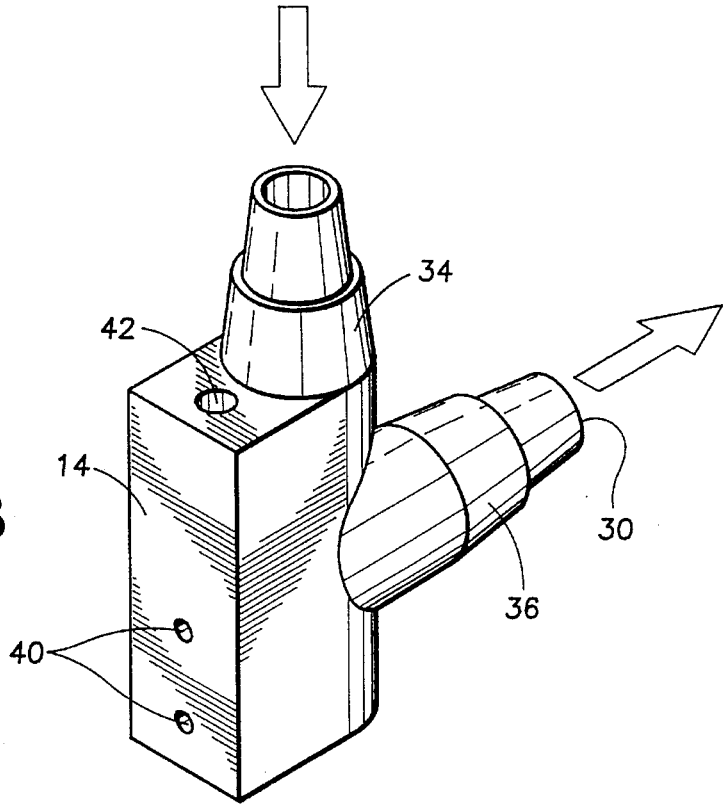
FIG. 3 is a perspective view of the overflow protector of the invention inverted showing the back side.

Referring now to FIGS. 2 and 3, the overflow protector 14 consists of a body of polyvinyl chloride or other suitable material and has an inlet connector 34 and an outlet connector 36. Since there is no significant pressure involved in the process, hoses, and particularly pool vacuum hoses could simply slip on the tapered connectors and hold with a friction fit, although it is within the scope of the invention to provide the connectors with external threads adapted for engaging garden hoses or the like. Expansion plug means 38 fits into the other end of the inlet passage on the vent passage 28 and is used when the system is configured for draining the pool. In operation, the system functions as described, however with the vent passage blocked the water will continue to flow if the system is charged and no air is allowed to enter. Placing the inlet hose back toward the bottom of the pool will subsequently drain the tank. Holes 40 accept screws for mounting the protector from the back side. Hole 42 is an alternative means of mounting, used particularly when the protector is operating with in ground pools and tanks, a simple rod approximately one quarter inch diameter is inserted into the ground on one end and into hole 42 on the other. The rod provides a more than adequate support for the protector.

Figure 4:
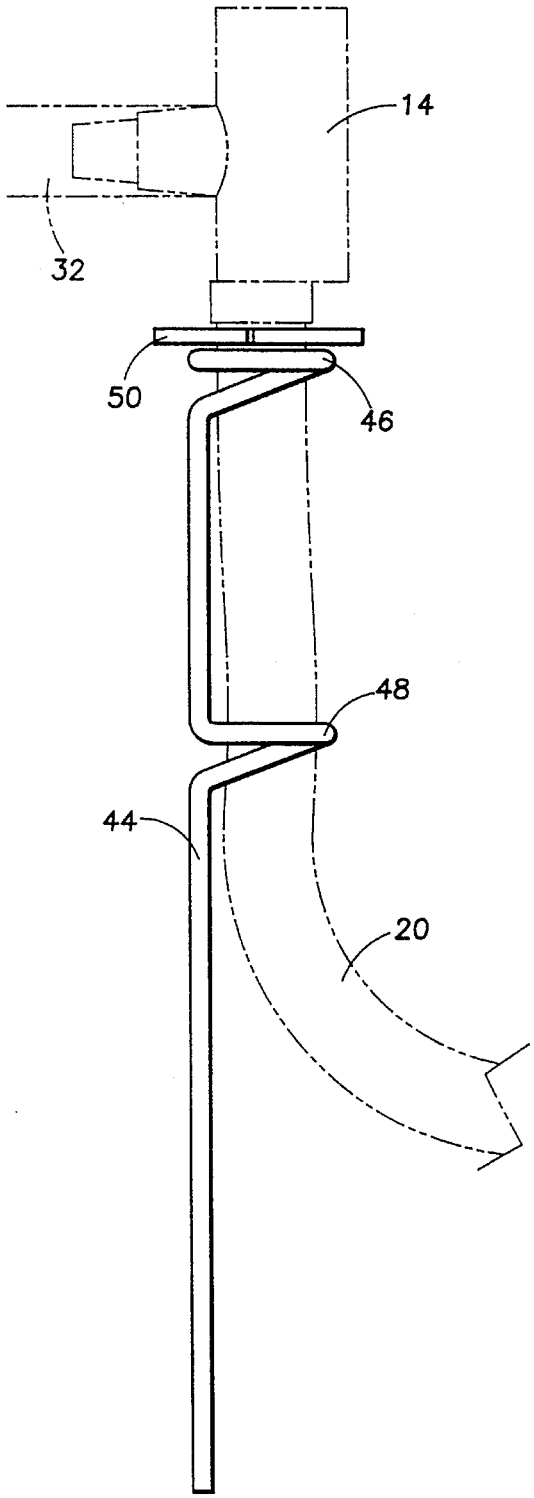
FIG. 4 is a view of a stake used to mount the invention at or near ground level.
Figure 5:
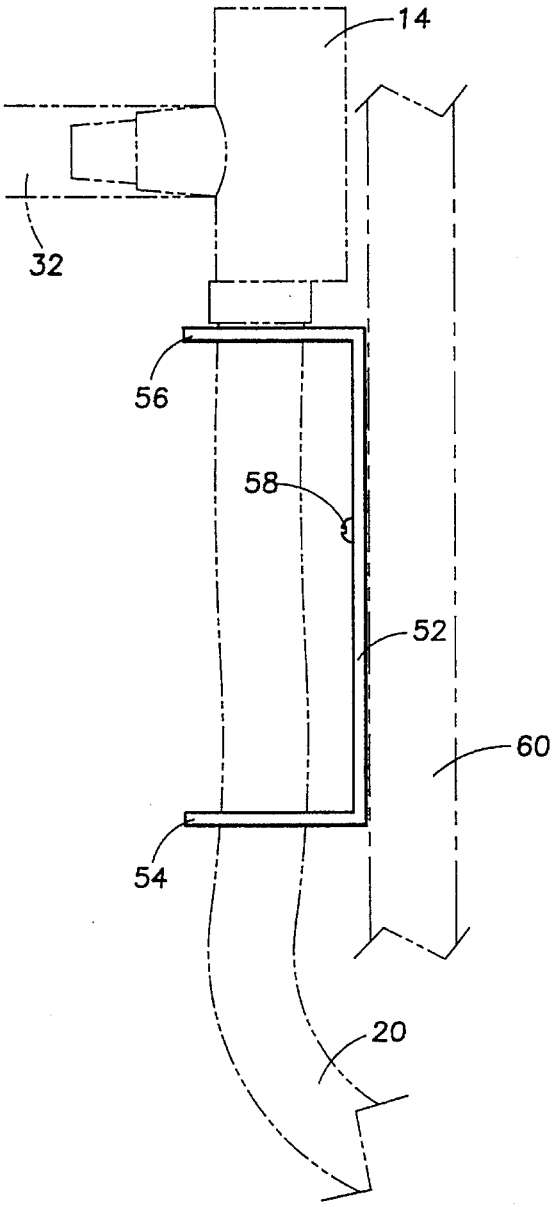
FIG. 5 is a view of a bracket used to mount the invention on the side of an above ground pool.

Referring to FIG. 4 a ground stake 44 is shown having a pair of generally spiral loops 46,48 for engaging the inlet hose 20 shown in phantom, the protector 14 rests on a plastic ring 50. FIG. 5 shows another alternative embodiment for supporting the protector including a plate 52 having both ends folded into parallel planes 54,56 containing apertures for the inlet hose 20. The protector rests on the surface on the desired plane. The plate is adapted to be fixed as by screw 58 to a vertical surface shown in phantom at 60.

It should be understood, of course, that the foregoing disclosure relates to only a preferred embodiment of the invention and that numerous modifications or alterations may be made therein without departing from the spirit and scope of the invention as set forth in the appended claims.

What is claimed is:

1. A fluid overflow protection system, for open pools containing a fluid therein, comprising:

(a) a protector member comprising;

an outlet passage, in the protector member, having an end of the outlet passage open;

an inlet passage, in the protector member, traverse to the outlet passage and communicating with the outlet passage at another end of the outlet passage;

an inlet connector attached to the protector member communicating with an end of the inlet passage; and an outlet connector, attached to the protector member, communicating with the end of the outlet passage that is open;

(b) an inlet swimming pool vacuum hose connected to the inlet connector;

(c) a weight means connected to one end of the inlet vacuum hose for causing the inlet vacuum hose to be submerged in the fluid;

(d) an outlet swimming pool vacuum hose connected to the outlet connector;

(e) an expandable plug means adapted to seal another end of the inlet passage; and (f) a protector support to support the protector member comprising a metal sheet folded at each end and containing apertures for supporting the inlet swimming pool vacuum hose and adapted for mounting on a vertical surface.

2. A fluid overflow protection system for open pools according to claim 1 wherein: the protector member is formed of poly vinyl chloride.

3. A fluid overflow protection system, for open pools containing a fluid therein, comprising:

(a) a protector member comprising;

an outlet passage, in the protector member, having an end of the outlet passage open;

an inlet passage, in the protector member, traverse to the outlet passage and communicating with the outlet passage at another end of the outlet passage;

an inlet connector attached to the protector member communicating with an end of the inlet passage; and an outlet connector, attached to the protector member, communicating with the end of the outlet passage that is open;

(b) an inlet swimming pool vacuum hose connected to the inlet connector;

(c) a weight means connected to one end of the inlet vacuum hose for causing the inlet vacuum hose to be submerged in the fluid;

(d) an outlet swimming pool vacuum hose connected to the outlet connector;

(e) an expandable plug means adapted to seal another end of the inlet passage; and (f) a protector support to support the protector member comprising a ground spike, including a pair of spaced apart loops for supporting the inlet swimming pool vacuum hose, and is adapted for placement in a ground location.

4. A fluid overflow protection system for open pools according to claim 3 wherein: the protector member is formed of poly vinyl chloride.

* * * * *